US005727734A

United States Patent [19]

Su

[11] Patent Number: 5,727,734

[45] Date of Patent: Mar. 17, 1998

[54] AUTOMATIC POP-UP DRINKING STRAW ASSEMBLY

[76] Inventor: Jeng-wann Su, No. 60, Huaite St., Taipei, Taiwan

[21] Appl. No.: 692,521

[22] Filed: Aug. 5, 1996

[51] Int. Cl.[6] ..... A47G 21/18

[52] U.S. Cl. ..... 239/33; 239/24; 215/388; 220/709

[58] Field of Search ..... 239/16, 24, 33; 215/388, 389; 220/705, 709, 710

[56] References Cited

U.S. PATENT DOCUMENTS

| | | | |
|---|---|---|---|
| 942,306 | 12/1909 | Clarke | 239/33 |
| 2,815,981 | 12/1957 | Nonnamaker et al. | 215/388 |
| 3,776,458 | 12/1973 | Chunga, Sr. | 239/24 |
| 5,253,779 | 10/1993 | Lee | 220/705 |

FOREIGN PATENT DOCUMENTS

| | | | |
|---|---|---|---|
| 904010 | 8/1962 | United Kingdom | 239/33 |

*Primary Examiner*—Andres Kashnikow
*Assistant Examiner*—Lisa Ann Douglas
*Attorney, Agent, or Firm*—Bacon & Thomas

[57] ABSTRACT

An automatic pop-up straw assembly comprises an outer tube, an inner tube, a resilient tube and a base. An air-tight connection between the inner tube and the resilient tube is achieved by inserting a reduced diameter of the second head of the resilient tube into the inner tube. Because the inner tube and the resilient tube are slidably received in the outer tube after the base is secured to the outer tube, the straw assembly is ready to be retained within a container with the compression of a helical tube of the resilient tube and the assembly will automatically pop-up when a cap of the container is opened.

4 Claims, 4 Drawing Sheets

FIG. 3

AUTOMATIC POP-UP DRINKING STRAW ASSEMBLY

FIELD OF THE INVENTION

The present invention generally relates to an automatic pop-up straw assembly and in particular to a drinking straw which is able to pop up and extend outward from a container which previously retained the straw, when the container is opened.

Drinking straws have been widely used throughout the world for centuries. People usually use a straw to suck out of beverage from a container and the straw is hygienically enclosed by paper, plastic or other materials, and then usually attached to the container or given to customers while they purchase a can or a bottle of beverage. This, will not only increase pollution to the environment due to the littering of wrapping paper, but also possibly pose a threat to the health of people after the straw which may not be clean is put into the bottle by hands. For the reason described above, a straw previously retained within a container is manufactured to avoid the beverage being contaminated through touching the straw by hand. Yet, drawbacks of this kind still bother people, for this kind of straw needs expensive mechanism to align the straw with an orifice defined the container.

Gul N. Lee U.S. Pat No. 5,253,779 discloses a beverage container having a sloping upper wall and enclosing a self-contained pop-up straw assembly. The straw assembly has telescopic inner and outer tubes and resilient means urging the tubes against the sloping container wall, causing the straw assembly to center itself and pop-up when the container is opened.

Referring to FIGS. 1 and 2, which are respectively a partly cross-sectional view of a straw constructed in accordance with the invention described above with a helix spring compressed within an outer tube and an exploded view of a straw with the helix spring fully extended. The straw comprises an inner tube 10, an outer tube 20 and a neck 30 having a diameter smaller than the diameter of the outer tube 20 to prevent the inner tube 10 from extending through a bottom of the outer tube 20. One end of the inner tube 10 is configured to have resilient means 11 (helical spring) which is provided integrally with the inner tube 10 and is inserted into the outer tube 20 to complete the assembling of the straw. One major drawback of the invention is that the resilient means 11 configured integrally with the inner tube 10 functions firstly as an urging means to urge the tubes against an upper wall of a container while the container is still closed and secondly as a spring to "pop-up" the straw when the container is opened, and does not provide a user an ability to completely suck beverage out from the container. Therefore, user of the straw while sucking beverage out from the container will have trouble continuously sucking beverage smoothly and evenly out from the container when the level of the beverage within the container is equal or even lower than the height of the inner tube 10, because air will leak into the inner tube 10 and disrupt the sucking process. Furthermore, part of the beverage will be left within the container when the level of the beverage falls below a height of the inner tube 10, and a user has to bend the straw over from where the resilient means 11 is configured to continue to suck the beverage remaining at the bottom of the container. Although the invention as shown in FIGS. 1 and 2 indeed improves the straw when comparing it with the prior design, it has drawbacks in sucking beverage from the container while the level of the beverage is lower than the height of the inner tube 10 of the straw.

SUMMARY OF THE INVENTION

The main objective of the present invention is to provide an automatic pop-up drinking straw assembly, more specifically, the straw assembly constructed in accordance with the present invention comprises an outer tube, an inner tube which is movably received within said outer tube and a resilient tube which is received within the outer tube when assembled and a base secured at the second end for preventing the resilient tube from extending beyond the bottom of the outer tube.

Still another objective of the invention is to provide an automatic pop-up drinking straw assembly which previously is retained within a container by means of an upper wall of the container, and the resilient tube, being compressed, will urge the straw assembly against the upper wall while the container is closed, in that, it prevents contamination of the beverage by hand.

It is yet another objective of the present invention to provide a straw assembly with easy operation, low cost and every advantage overcoming the disadvantages of the prior art i.e., the one described above.

It is still a further objective of the present invention to provide an automatic pop-up drinking straw assembly urged by means of its resilient tube being configured, at a second part, to be helical spiral, thus the straw assembly will pop up automatically when the container is opened by the previously compressed resilient tube.

BRIEF DESCRIPTION OF THE DRAWINGS

The present invention will now be better understood from the following description of a preferred embodiment of the present invention, with reference to the attached drawings, wherein.

DETAILED DESCRIPTION OF THE INVENTION

Figure 2:
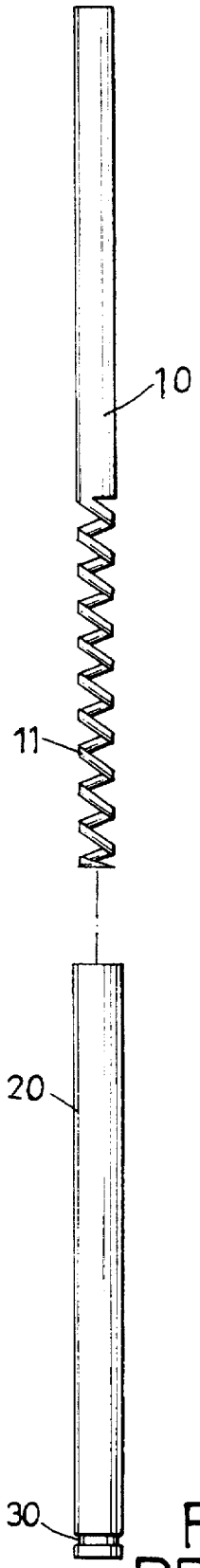
FIG. 2 PRIOR ART
FIG. 2 is an exploded view of a prior straw assembly with a resilient means.
Figure 1:
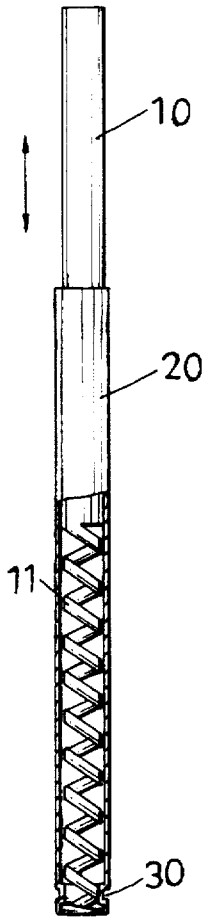
FIG. 1 PRIOR ART
FIG. 1 is a partly cross-sectional view of a prior art.
Figure 3:
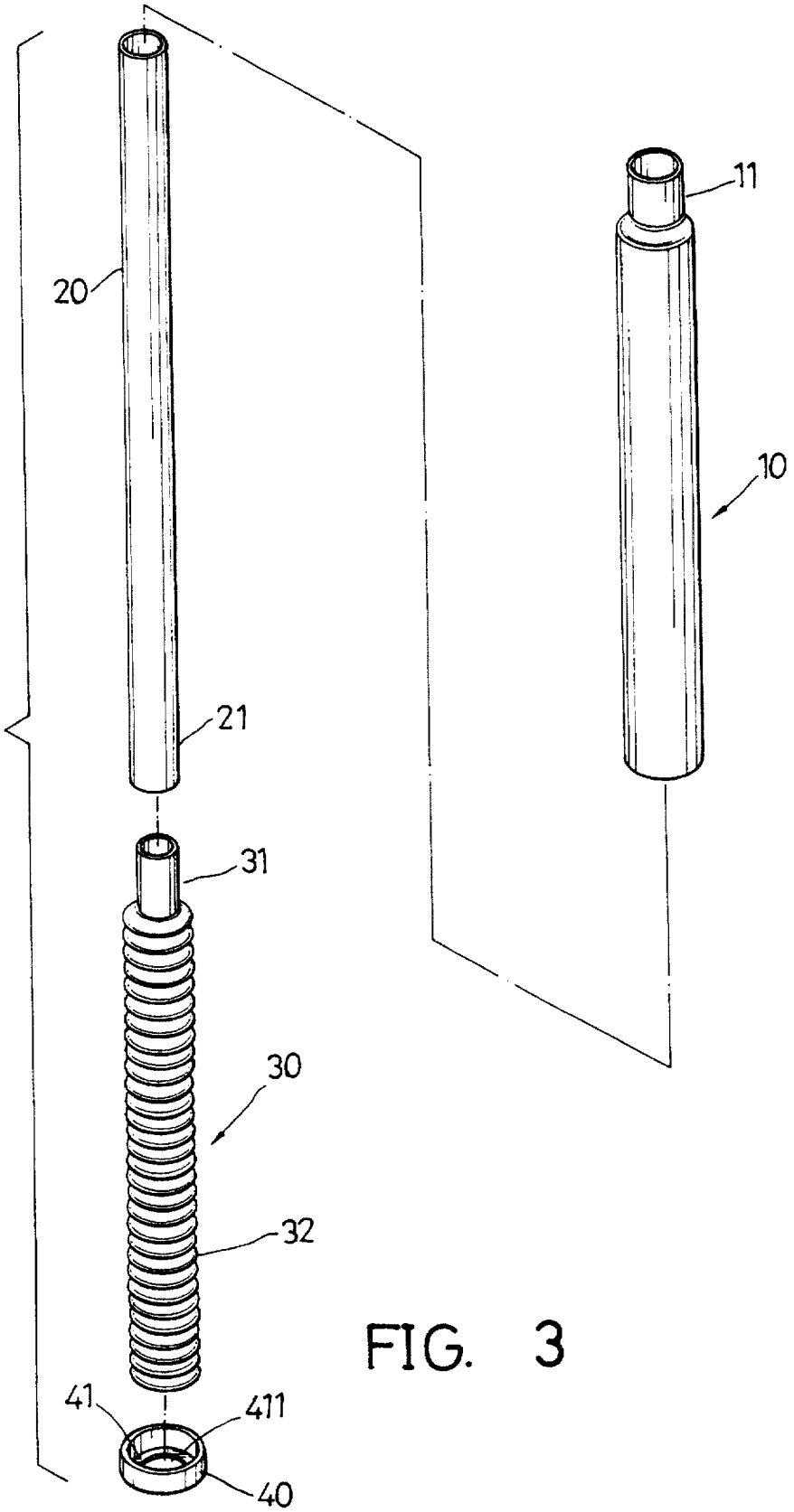
FIG. 3 is an exploded view of a straw assembly constructed in accordance with the present invention.
Figure 7:
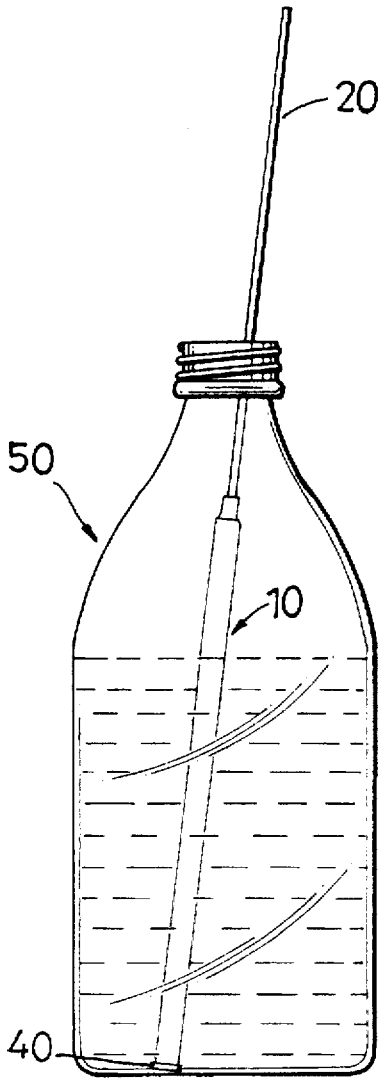
FIG. 7 is another embodiment of the present invention showing the straw assembly is released from the position of compression.

With reference to the drawings and in particular to FIGS. 3, to FIG. 7, wherein an automatic pop-up straw assembly constructed in accordance with the present invention is shown.

Referring to FIG. 3, The straw assembly comprises an inner tube 20, an outer tube 10 having a first head 11 with a diameter smaller than the remaining of the outer tube 10 and is bigger than a diameter of the inner tube 20, a resilient tube 30 which is configured to have a second head 31 having a diameter slightly smaller than the diameter of the inner tube 20, a helical tube 32, and a base 40 configured to have a hole aligned respective with the holes of the inner tube 20 and the outer tube 10. The base 40 is also integrally provided with an inward flange 41 at the bottom to decrease a diameter of an exit 411 of the base 40, such that it is smaller than a diameter of the helical tube 32 for providing support to the resilient tube 30.

Figure 5:
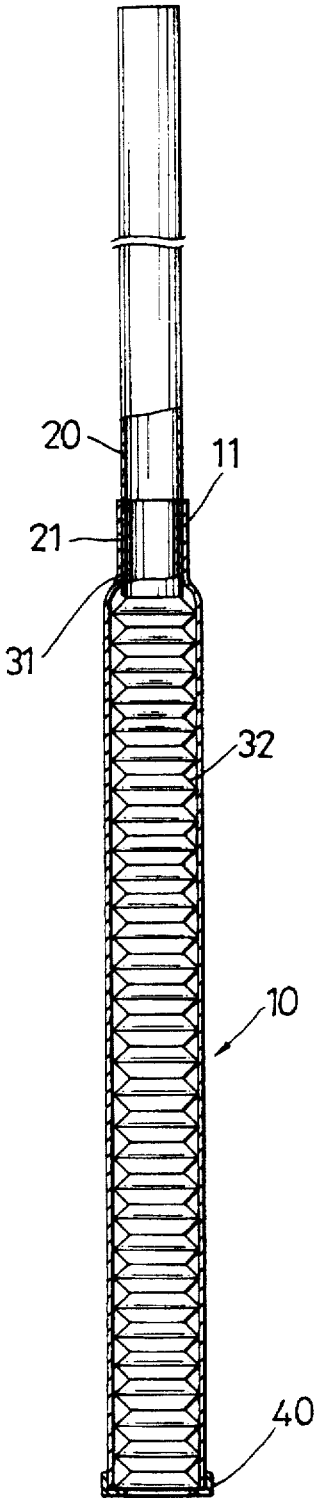
FIG. 5 is also a sectional view in part of the present invention showing the resilient tube is being released from the position of compression.
Figure 4:
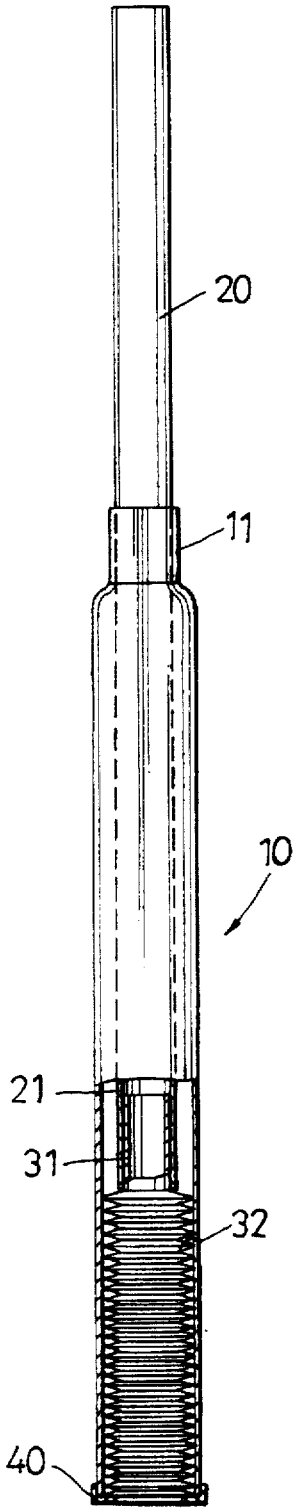
FIG. 4 is a sectional view in part of the present invention showing the resilient tube is being compressed.

Referring to FIGS. 4 and 5 which are two embodiments of the straw assembly constructed in accordance with the present invention. The straw assembly, when assembled together, has the resilient tube 30, with the base 40 secured at the bottom thereof, inserted into the outer tube 10, and because the diameter of the first head 11 of the outer tube 10 is bigger than the diameter of the second head 31 of the resilient tube 30, the second head 31 is covered by the first head 11 after assembling of the outer tube 10 and the resilient tube 30. When the assembly of the outer tube 10 and the resilient tube 30 is completed, a first end 21 of the inner tube 20 is connected with the second head 31 of the resilient tube 30 and forms an air-tight connection, for an inner diameter of the inner tube 20 is equal to an outer diameter of the second head 31 of the resilient tube 30. Thus, while the connection between the inner tube 20 and the second head 31 of the resilient tube 30 is completed, the straw assembly with resilience coming from the helical tube 32 is ready to be used to suck beverage out from a container.

Figure 6:
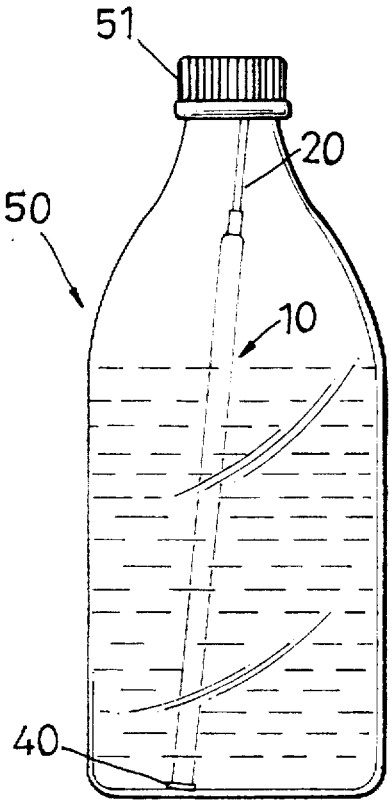
FIG. 6 is one embodiment of the present invention showing the straw assembly is being compressed within a container by the upper wall of the container.

Referring to FIGS. 5 and FIG. 6, the straw assembly, when being put inside a container 50 with a cap 51 secured at the opening provided at the top of the container 50, is compressed by means of the cap 51 and the length of the assembly is reduced due to the compression of the helical tube 32.

Still referring respective to FIG. 4 and FIG. 7, after the cap 51 is removed from the top of the container 50, the urging force from the compression of the helical tube 32 to the assembly is released and therefore, the assembly stretches outward and achieves a length of the assembly as shown in FIG. 5. The increase of the length of the assembly stops when an upper part of the helical tube 32 is biased by the first head 11 of the outer tube 11 or the assembly is fully stretched.

Although the present invention has been described with a certain degree of particularity, it is obvious that the above disclosure has been made by way of example only and that numerous changes and modifications in the detailed construction and the combination and the arrangement of parts may be resorted to without departing from the spirit and scope of the invention as hereinafter claimed.

What is claimed is:

1. An automatic pop-up drinking straw assembly comprising:

an outer tube having a first head with a diameter smaller than the remaining of said outer tube;

an inner tube having a first end;

a resilient tube having a second head whose outer diameter is equal to said inner diameter of said inner tube and a helical tube with a diameter bigger than the outer diameter of said second head of said resilient tube but smaller than the diameter of said outer tube;

a base provided with a hole mated respective with said resilient tube, said inner tube and said outer tube, and having a peripheral flange extending inward for providing support to said helical tube of said resilient tube.

2. The straw assembly as claimed in claim 1, wherein an air-tight connection is achieved after said second head of said resilient tube is inserted into said inner tube.

3. The straw assembly as claimed in claim 1, wherein said resilient tube and said inner tube are slidably received within said outer tube.

4. The straw assembly as claimed in claim 1, wherein said base connects securely with said outer tube and the bottom of said helical tube of said resilient tube.

* * * * *